US005435799A

United States Patent [19]

Lundin

[11] Patent Number: 5,435,799

[45] Date of Patent: Jul. 25, 1995

[54] CIRCUIT TRAINING EXERCISE APPARATUS

[75] Inventor: Christopher B. Lundin, Newark, Del.

[73] Assignee: Physiq, Inc., Bellmawr, N.J.

[21] Appl. No.: 80,765

[22] Filed: Jun. 24, 1993

[51] Int. Cl.[6] ..... A63B 71/00

[52] U.S. Cl. ..... 482/8; 482/1; 482/130; 482/901; 73/379.01

[58] Field of Search ..... 482/1, 4–8, 482/96, 130, 900–902; 128/25 R, 25 B; 364/413.02; 73/379.01; 601/23

[56] References Cited

U.S. PATENT DOCUMENTS

| | | | |
|---|---|---|---|
| 4,408,613 | 10/1983 | Relyea | 482/8 X |
| 4,566,461 | 1/1986 | Lubell et al. | 482/8 X |
| 4,817,940 | 4/1989 | Shaw et al. | 482/901 X |
| 4,828,257 | 5/1989 | Dyer et al. | 482/901 X |
| 4,911,438 | 3/1990 | Van Straaten | 482/130 X |
| 4,998,725 | 3/1991 | Watterson et al. | 482/8 X |
| 5,018,726 | 5/1991 | Yorioka | 482/902 X |
| 5,158,093 | 10/1992 | Shvartz et al. | 482/8 X |

*Primary Examiner*—Joe H. Cheng

*Attorney, Agent, or Firm*—Norman E. Lehrer; Jeffrey S. Ginsberg

[57] ABSTRACT

An exercise apparatus includes the combination of a multipurpose exercise machine capable of allowing a person to perform a number of different anaerobic exercises thereon and an aerobic exercise machine such as a stair climber, treadmill, bicycle or the like associated therewith. A program computer is mounted on one of the machines so as to be readily accessible to the person exercising. The computer includes a memory which has a plurality of exercise programs stored therein which can be selected by the user. Once a particular program is selected, the computer causes a display to advise the user as to which particular exercise is to be performed and for how long. The computer indicates the conclusion of the particular exercise time and the beginning of a transition time where the user is to move on to the next exercise which is then timed and the process continues throughout the exercise program. The transition times can be selectively shortened or lengthened to accommodate beginner, intermediate or advanced users and a plurality of displays provide information to the user relating to his or her exercise program.

34 Claims, 3 Drawing Sheets

Fig. 4

| STATION NO. | STATION | LEVEL "C" TRANSITION TIME | EXERCISE TIME | TOTAL TIME |
|---|---|---|---|---|
| 1 | Stairclimber/Aerobic | 0:10 | 2:00 | 2:10 |
| 2 | Pullovers | 0:15 | 0:24 | 2:49 |
| 3 | Lat Pull-downs | 0:10 | 0:24 | 3:23 |
| 4 | Stairclimber/Aerobic | 0:10 | 2:00 | 5:33 |
| 5 | Chest Fly | 0:15 | 0:24 | 6:12 |
| 6 | Reverse Fly | 0:10 | 0:24 | 7:46 |
| 7 | Stairclimber/Aerobic | 0:10 | 2:00 | 9:56 |
| 8 | Crunch | 0:15 | 0:24 | 10:35 |
| 9 | Under Arm Pull | 0:10 | 0:24 | 11:09 |
| 10 | Stairclimber/Aerobic | 0:10 | 2:00 | 13:19 |
| 11 | Squat | 0:15 | 0:24 | 13:58 |
| 12 | Calf Raise | 0:10 | 0:24 | 14:32 |
| 13 | Stairclimber/Aerobic | 0:10 | 2:00 | 16:42 |
| 14 | Sit-up | 0:15 | 0:24 | 17:21 |
| 15 | Leg Curl | 0:10 | 0:24 | 17:55 |
| 16 | Stairclimber/Aerobic | 0:10 | 2:00 | 19:05 |
| 17 | Military Press | 0:15 | 0:24 | 19:44 |
| 18 | Pull-up | 0:10 | 0:24 | 20:18 |
| 19 | Stairclimber/Aerobic | 0:10 | 2:00 | 22:28 |
| 20 | Upright Row | 0:20 | 0:24 | 23:12 |
| 21 | Tricep Extension | 0:15 | 0:24 | 23:51 |
| 22 | Stairclimber/Aerobic | 0:10 | 2:00 | 25:01 |
| 23 | Bicep Curl | 0:15 | 0:24 | 25:40 |
| 24 | Back Extension | 0:15 | 0:24 | 26:19 |
| 25 | Stairclimber/Aerobic | 0:10 | 3:41 | 30:00 |

CIRCUIT TRAINING EXERCISE APPARATUS

BACKGROUND OF THE INVENTION

The present invention is directed toward an exercise apparatus and, more particularly, toward such an apparatus which is particularly useful in circuit training.

Circuit training is a time-efficient method of training during which a group of exercises are performed in a specified order with predetermined work-rest ratios. These exercises can be strictly anaerobic (strength training) or can be a combination of strength training and aerobic training. While both alternatives have been shown to elicit measurable training effects, research has determined that the latter, which alternates between anaerobic and aerobic exercise, is the most beneficial in regard to the development of both cardiovascular and muscular fitness.

As is known in the art, the key to successful circuit training is to exercise at an intensity that elevates and maintains an exercise heart rate within one's target heart rate zone. In order to do so, it is important that the work-rest ratios be established in such a manner as to allow enough transition time between exercises to make the necessary adjustments to the equipment and/or changes between exercises but not so much that the exercise heart rate dips below the lower limit of the prescribed target heart rate zone.

The ratio between the number of anaerobic and aerobic exercises also plays an important role in combination circuit training. If one's goal is to develop a balance between cardiovascular and muscular fitness, the ratio should be 1 to 1 (one anaerobic exercise to one minute of aerobic exercise) or 2 to 2. If the goal is geared toward cardiovascular fitness, the ratio should favor aerobic exercise 1 to 2 (one anaerobic exercise to two minutes of aerobic exercise). Conversely, if the primary goal is anaerobic, the ratio should favor anaerobic exercise 2 to 1 (two anaerobic exercises to one minute aerobic exercise).

Heretofore, circuit training has been confined to fitness clubs where 15 to 30 individual stations have been used with a predetermined start and finish station and an instructor, speaker or light system which is used to move multiple people through a circuit system. In order to ensure that every person moves to the next station at the same time, the time allowed at each station must be identical and the amount of time needed to move to the next station and set it up (transition time) must also be identical. It is well known, however, that people move at different speeds and that the amount of time exercised by one person may not be right for the next person. Obviously, with such an arrangement, one person improperly performing or delaying his movement from one station to another will interfere with the entire circuit training for everyone.

Various home gyms available on the market have categorized their systems as circuit trainers and have promoted circuit training. None, however, has provided either a machine capable of adapting to circuit training and/or a timing system to control the transition time between exercises, the exercise time and the total elapsed time. This is particularly important since, as pointed out above, different people have different capabilities and this must be allowed for in the transition time and exercise time and intensity.

SUMMARY OF THE INVENTION

The present invention overcomes the problems of the prior art and provides a home-type gym or exercising machine which allows for true circuit training. According to the invention, exercise machines or apparatuses are provided which include and/or can be converted into a plurality of different exercise stations wherein a plurality of different anaerobic exercises and at least one aerobic exercise can be performed. The apparatus also includes a program board with a computer therein and a user-friendly monitoring system for guiding the user through a selected exercise program. The computer includes a memory which has a plurality of exercise programs stored therein which can be selected by the user. Once a particular program is selected, the computer causes a display to advise the user as to which particular exercise is to be performed and for how long. The computer indicates the conclusion of the particular exercise time and the beginning of a transition time where the user is to move on to the next exercise which is then timed and the process continues throughout the exercise program. The transition times can be selectively shortened or lengthened to accommodate beginner, intermediate or advanced users and a plurality of displays provide information to the user relating to his or her exercise program.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

FIG. 4 represents a sample exercise program for use with the invention, and

DETAILED DESCRIPTION OF THE PREFERRED EMBODIMENT

Figure 1A:
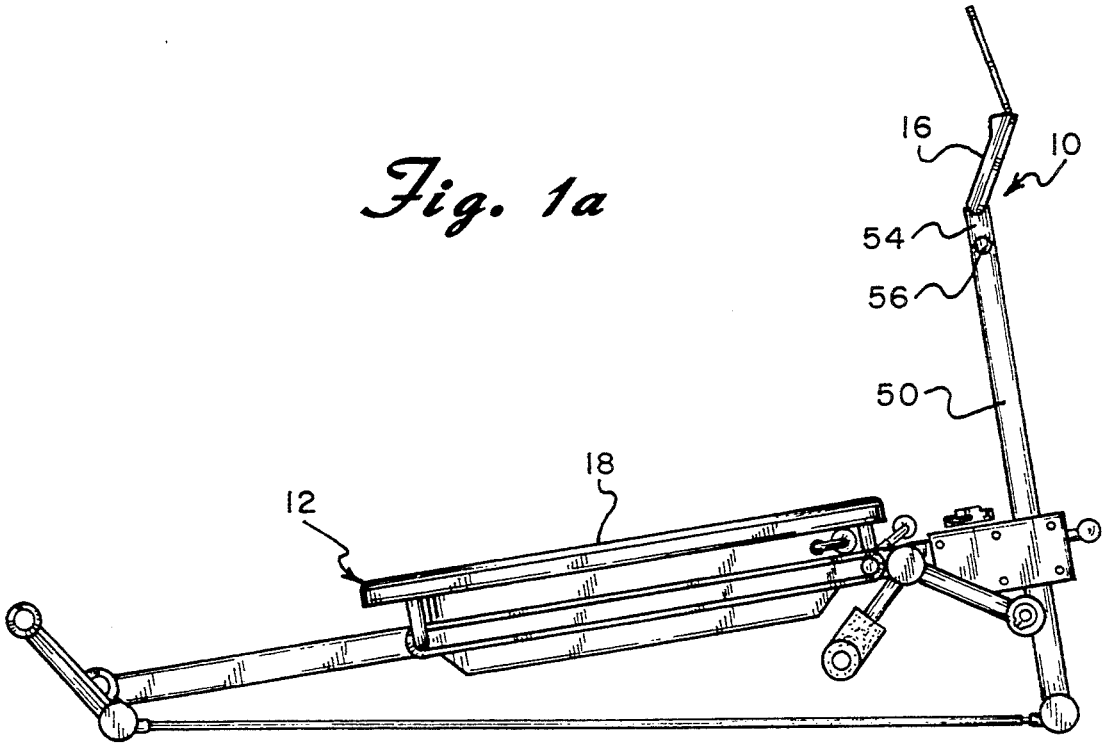
FIGS. 1*a* and 1*h* are side elevational views of exercise apparatuses capable of permitting a user to perform a plurality of anaerobic and aerobic exercises.
Figure 1B:
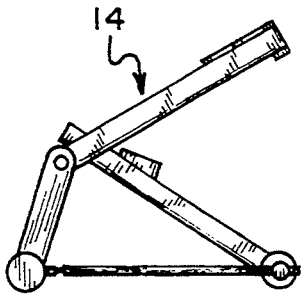

Referring now to the drawings in detail wherein like reference numerals have been used throughout the various figures to designate like elements, there is shown in FIGS. 1*a* and 1*b* circuit training exercise apparatuses constructed in accordance with the principles of the present invention and collectively designated generally as 10. The apparatuses 10 are comprised essentially of three major components: a first exercise machine 12, a second exercise machine 14 and a program board 16 mounted on the first machine 12 so as to be accessible by a person utilizing the machine.

Exercise machine 12 is a multi-purpose machine which permits a person utilizing the machine to perform a plurality of different anaerobic exercises thereon. This is a known device which is shown and described, for example, in U.S. Pat. No. 4,911,438.

As is well known in the art, the person utilizing the anaerobic exercise machine 12 can arrange his or her body in various different orientations on the bench 18 and utilizing ancillary devices arranged in relation to the bench 18, can perform a number of different exercises such as pullovers, lat pull-downs, chest fly, reversed fly, leg curls, bicep curls, etc. It is, of course, sometimes necessary to rearrange the bench 18 and the auxiliary equipment in order to perform each exercise. Each rearrangement of the equipment for the performance of a particular exercise may generally be referred to as a station. At any particular station, it may be possible to perform more than one anaerobic exercise. However, for convenience, each particular exercise may be referred to herein as a station.

The foregoing is by way of example only. The present invention may also be useful with other multi-purpose type anaerobic exercise machines wherein the user can move to or rearrange the machine to different stations. It may also be possible to utilize the present invention with a plurality of distinct single purpose type machines which are arranged in very close proximity to each other. For convenience, however, even a plurality of distinct machines arranged together may be referred to herein as a single machine.

The second exercise machine 14 is commonly referred to as a stair climber and is per se well known in the art. The stair climber 14 allows a person to perform an aerobic exercise when utilizing the same.

Although the exercising apparatus is illustrated with a stair climber 14, this is by way of example only. Other types of aerobic machines such as a treadmill, a stationary bicycle or the like could similarly be utilized. Furthermore, the aerobic exercise machine 14 may be physically attached to the first machine 12.

The program board 16 is the heart of the present invention and is mounted on the first exercise machine 12 so as to be readily visible to and accessible by a person utilizing the machines. As will be apparent to those familiar with equipment of this class, program boards per se are not new. Prior boards, however, were merely mechanical devices which included a plurality of interchangeable cards or charts which described a series of different exercises, commonly referred to as an exercise program.

Figure 2:
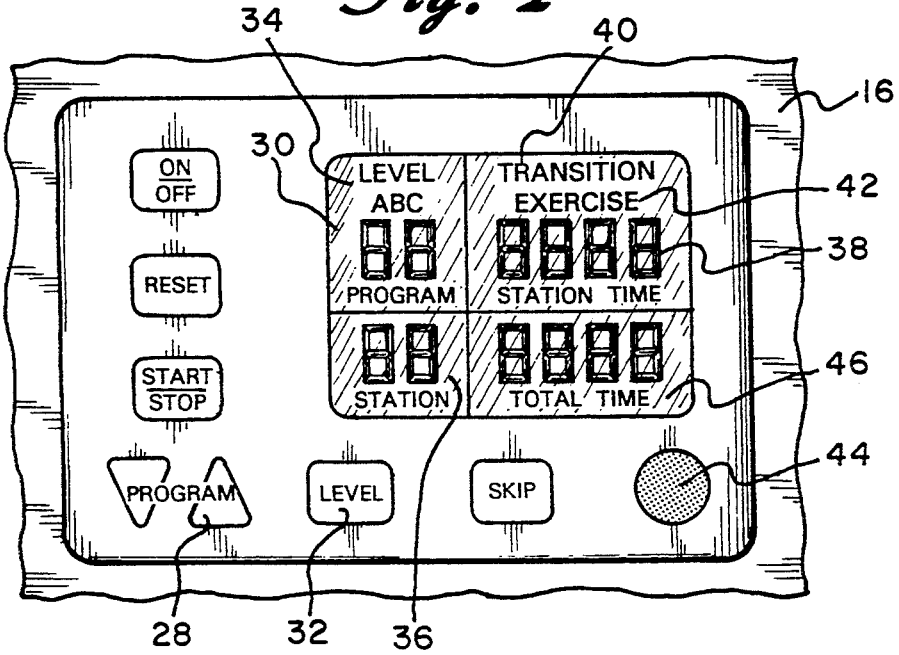
FIG. 2 is a diagrammatic representation of the computer program hoard of the invention.
Figure 3:
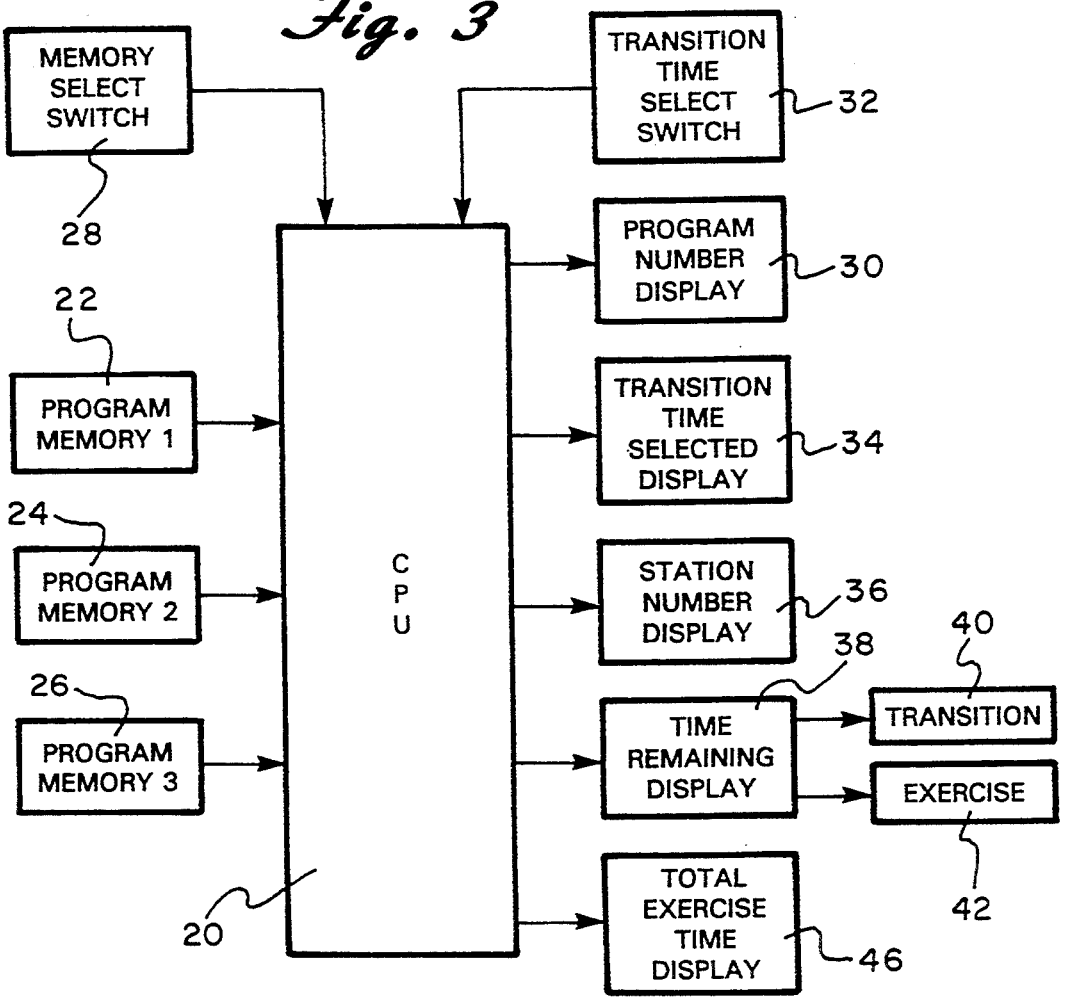
FIG. 3 is a schematic representation of the program computer.

The program board 16 includes a display area thereon which is shown most clearly in FIG. 2 and includes a computer therein which is shown schematically in FIG. 3. As mentioned above, an exercise program is a prearranged group or series of exercises. For proper circuit training, each group should include a plurality of anaerobic exercises intermingled with at least one aerobic exercise repeated throughout the program. A well-defined exercise program includes not only the specific series of exercises but also the amount of time that the exercise must be performed and the transition time between exercises. The transition time must, of course, be long enough to allow a user to move from one station to the next which may also entail rearranging the equipment in order to be capable of use for a particular exercise but must not be of such duration to allow the person's exercise heart rate to dip below the lower limit of his prescribed target heart rate zone. Normally a beginner will need more transition time while a more advanced person will require and should, therefore, be allocated less transition time.

The heart of the computer shown in FIG. 3, which essentially controls all of the operations thereof, is the central processing unit 20. A plurality of memory devices or addresses such as shown at 22, 24 and 26 are provided for storing a plurality of different exercise programs. While only three such memory means are shown in FIG. 3, it should be readily apparent that a much larger number and preferably more than ten can be included.

Stored in each of the program memories is information representing a different but identifiable exercise program. This program is a prearranged series of a combination of anaerobic and aerobic exercises. The information which is stored includes not only the specific exercises but the time duration for each specific exercise and information relating to the transition times between exercises (although this can be changed as indicated below). The information relating to the exercise itself may be merely a number representing a particular exercise, a name of the exercise or a symbol or design or the like illustrating the exercise. If merely a number is used, the user may also be provided with an exercise chart for each program which illustrates and/or explains each exercise corresponding to each number.

One or more memory or program select switches such as shown at 28 in FIGS. 2 and 3 can be used for selecting the particular exercise program from the different memory locations. The particular exercise program selected will be displayed on display 30, preferably by indicating the number of the program which has been selected.

The transition time between exercises (i.e. between stations) can also be selected by utilizing the transition time select switch 32. Preferably, three different transition times can be stored in the computer which may represent the proper times for a beginner, intermediate and advanced user. The display 34 in the upper portion of the display 30 can be utilized to indicate the selected transition time. This can be done, for example, by flashing either the letter "A" for beginner, "B" for intermediate or "C" for advanced.

As the selected exercise program progresses, the number of the particular exercise currently required to be performed is displayed on the display 36. In lieu of a number or in addition thereto, the name of the exercise or a symbol or design or the like representing the exercise could be displayed.

The amount of time allocated within the selected program for a particular exercise or station and for the current transition time is displayed in the time display 38. Display 38 starts with the full allocated amount of time and counts down to zero. Displays 40 and 42 located at the top of display 38 indicate whether the time being counted is the transition time or exercise time, respectively. It is also possible to utilize colored lights to indicate to a user when a particular exercise is to begin and when it is to be ended. Thus, a green light could indicate that an exercise is to begin while a red light would indicate that it is over. Similarly, the red light would then indicate the beginning of a transition time while the green light would indicate the end of the transition time. In lieu of these lights or in addition thereto, the beginning and end of each of these time periods could be announced audibly through speaker 44 by various tones such as beeps and/or bongs. It is also within the scope of this invention to have other information such as a description of the particular exercise within the program announced audibly through the speaker 44.

The total amount of exercise time which has been accumulated during a program can be shown in the display 46. The display area of the board 16 may also include a standard clock and a number of other switches for turning the computer on and off, for resetting the same, for temporarily pausing a program or for skipping a particular exercise. Implementing these commands could, of course, be easily accomplished through the use of the central processing unit 20.

Figure 5:
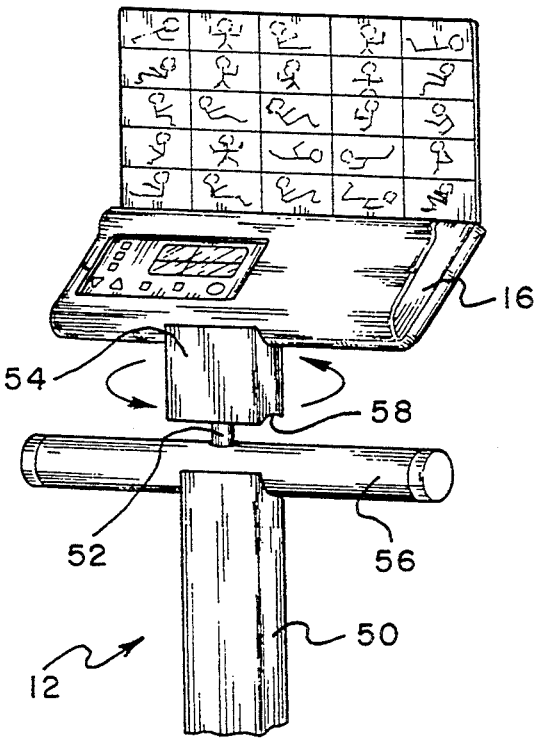
FIG. 5 is a perspective view showing the manner in which the computer program board attaches to the exercise apparatus.

So that the program board 16 can be seen by the user of either the exercise machine 12 or the stair climber 14, it is preferable to have the same be mounted so as to be rotatable on the forward vertical support 50 of the machine 12. As shown in FIG. 5, this can be easily accomplished by having the program board 16 mounted for rotation about the vertical pin 52 which extends between the bottom 54 of the board and the cross bar 56 at the top of the support 50. In order to rotate the board 16, the same is lifted slightly and then rotated around 180°. The board is then lowered back into place wherein the curved surface 58 of the underside of the support 54 rests on the bar 56 in order to maintain the board in position.

The present invention is utilized in the following manner. After the program computer 16 is turned on, the user selects the desired program by pushing the switch or switches 28 until the selected program number appears in the display 30. The selected program may be, for example, the program shown in FIG. 4. After the desired program is selected, the user then pushes the level button 32 to select the beginner, intermediate or advanced transition time. Thereafter, the user may push the start button 50.

The display on the program board will then show that, for example, the user should be at station 1 for the stair climber aerobic exercise and that he has a transition time of 10 seconds to get there and begin exercising. The exercise duration for the first stair climber aerobic exercise is 2 minutes. Thus, after the 10 seconds times out as shown at display 38, the transition light 40 will turn off and the exercise light 42 will turn on. There would then be a 2-minute time indicated on display 38 which will begin counting down.

Since the user may not have the program board 16 in view, a green light may be used and/or an audible signal from the speaker 24 could advise the user that it is time to begin exercising on the stair climber. Similarly, after the 2 minutes run out, a red light and/or an audible signal may advise the user that the stair climber exercise is over. At this point, the number 2 will appear in the display 36 to indicate that a pullover exercise should be performed next and a 15 second transition time will be indicated in display 38 along with the flashing of the transition light 40. The exercise program computer 16 will continue in this manner until all of the exercises shown in FIG. 4 have been performed.

The present invention may be embodied in other specific forms without departing from the spirit or essential attributes thereof and accordingly reference should be made to the appended claims rather than to the foregoing specification as indicating the scope of the invention.

I claim:

1. Exercise apparatus for circuit training including:

a first exercise machine capable of permitting a person to perform a plurality of different anaerobic exercises thereon;

a second exercise machine which allows a person to perform at least one aerobic exercise thereon;

a program board mounted on one of said machines so as to be accessible by a person utilizing said machine, said program board having a display area thereon and including computer means therein, said computer means including memory means;

a plurality of different but separately identifiable exercise programs stored within said memory means;

each of said exercise programs being comprised of prearranged information representing a different series of a combination of anaerobic and aerobic exercises, said information including time durations for each specific exercise within each series and including transition times between exercises;

means for changing the duration of said transition times;

means for selecting one of said exercise programs from said computer means, and means within said display area for displaying indicia representing the exercise program selected.

2. The invention as claimed in claim 1 wherein said memory means includes three different sets of transition times stored therein and wherein said means for changing the duration of said transition times includes means for selecting one of said stored sets of transition times.

3. The invention as claimed in claim 2 further including means for displaying indicia representing which one of the three sets of transition times has been selected by the user.

4. The invention as claimed in claim 1 further including means for sequentially displaying indicia representing the exercises within the selected exercise program.

5. The invention as claimed in claim 1 further including a timing means and a time display means for displaying the amount of time remaining during each exercise and during each transition time.

6. The invention as claimed in claim 5 further including means for indicating whether said time display means is displaying an exercise time or a transition time.

7. The invention as claimed in claim 5 further including first indicating means for indicating when an exercise time period is to begin and second indicating means for indicating when an exercise time period is over.

8. The invention as claimed in claim 7 wherein said first and second indicating means provide two different visual indications.

9. The invention as claimed in claim 7 wherein said indicating means provides an audible indication.

10. A program computer for use with exercise equipment of the type which permits a user of said equipment to perform a plurality of different anaerobic exercises and at least one aerobic exercise comprising:

memory means within said computer;

a plurality of different exercise programs stored within said memory means;

each of said exercise programs being comprised of information representing a series of a combination of anaerobic and aerobic exercises, said information including time durations for each exercise within each series and including transition times between exercises;

means for changing the duration of said transition times;

means for selecting one of said exercise programs, and means for indicating which of said exercise programs has been selected.

11. The invention as claimed in claim 10 wherein said memory means includes three different sets of transition times stored therein and wherein said means for changing the duration of said transition times includes means for selecting one of said stored sets of transition times.

12. The invention as claimed in claim 11 further including means for displaying indicia representing which one of the three sets of transition times has been selected by the user.

13. The invention as claimed in claim 10 further including means for sequentially displaying indicia representing the exercises within the selected exercise program.

14. The invention as claimed in claim 10 further including a timing means and a time display means for displaying the amount of time remaining during each exercise and during each transition time.

15. The invention as claimed in claim 14 further including means for indicating whether said time display means is displaying an exercise time or a transition time.

16. The invention as claimed in claim 14 further including first indicating means for indicating when an exercise time period is to begin and second indicating means for indicating when an exercise time period is over.

17. The invention as claimed in claim 16 wherein said first and second indicating means provide two different visual indications to the user.

18. The invention as claimed in claim 16 wherein said indicating means provides an audible indication to the user.

19. A program computer for use with exercise equipment of the type which permits a user of said equipment to perform a plurality of different exercises comprising:

memory means within said computer;

a plurality of different exercise programs stored within said memory means;

each of said exercise programs being comprised of information representing a series of exercises, said information including time durations for each exercise within each series and including transition times between exercises;

means for changing the duration of said transition times;

means for selecting one of said exercise programs, and means for indicating which of said exercise programs has been selected.

20. The invention as claimed in claim 19 wherein said memory means includes three different sets of transition times stored therein and wherein said means for changing the duration of said transition times includes means for selecting one of said stored sets of transition times.

21. The invention as claimed in claim 20 further including means for displaying indicia representing which one of the three sets of transition times has been selected by the user.

22. The invention as claimed in claim 19 further including means for sequentially displaying indicia representing the exercises within the selected exercise program.

23. The invention as claimed in claim 19 further including a timing means and a time display means for displaying the amount of time remaining during each exercise and during each transition time.

24. The invention as claimed in claim 23 further including means for indicating whether said time display means is displaying an exercise time or a transition time.

25. The invention as claimed in claim 23 further including first indicating means for indicating when an exercise time period is to begin and second indicating means for indicating when an exercise time period is over.

26. The invention as claimed in claim 25 wherein said first and second indicating means provide two different visual indications to the user.

27. The invention as claimed in claim 25 wherein said indicating means provides an audible indication to the user.

28. A program computer for use with exercise equipment of the type which permits a user of said equipment to perform a plurality of different exercises comprising:

memory means within said computer;

a plurality of different exercise programs stored within said memory means;

each of said exercise programs being comprised of information representing a series of exercises, said information including time durations for each exercise within each series and including transition times between exercises;

means for selecting one of said exercise programs;

means for indicating which of said exercise programs has been selected, and means for sequentially displaying indicia representing the exercises within the selected exercise program.

29. The invention as claimed in claim 28 further including a timing means and a time display means for displaying the amount of time remaining during each exercise and during each transition time.

30. A program computer for use with exercise equipment of the type which permits a user of said equipment to perform a plurality of different exercises comprising:

memory means within said computer;

a plurality of different exercise programs stored within said memory means;

each of said exercise programs being comprised of information representing a series of exercises, said information including time durations for each exercise within each series and including transition times between exercises;

means for selecting one of said exercise programs;

means for indicating which of said exercise programs has been selected, and timing means and time display means for displaying the amount of time remaining during each exercise and during each transition time.

31. The invention as claimed in claim 30 further including means for indicating whether said time display means is displaying an exercise time or a transition time.

32. The invention as claimed in claim 30 further including first indicating means for indicating when an exercise time period is to begin and second indicating means for indicating when an exercise time period is over.

33. The invention as claimed in claim 32 wherein said first and second indicating means provide two different visual indications.

34. The invention as claimed in claim 32 wherein said indicating means provides an audible indication.

* * * * *